United States Patent [19]

Szugda

[11] 4,304,399

[45] Dec. 8, 1981

[54] WORKPIECE CLAMP

[75] Inventor: Bernard Szugda, Southbridge, Mass.

[73] Assignee: Bermer Tool & Die, Inc., Southbridge, Mass.

[21] Appl. No.: 24,704

[22] Filed: Mar. 28, 1979

[51] Int. Cl.[3] ..... B25B 1/10

[52] U.S. Cl. ..... 269/88; 269/93

[58] Field of Search ..... 269/88, 91–93, 269/244, 246

[56] References Cited

U.S. PATENT DOCUMENTS

| | | | |
|---|---|---|---|
| 928,657 | 7/1909 | Howell | 269/93 |
| 1,026,475 | 5/1912 | Tarbuck . | |
| 1,382,400 | 7/1921 | Ross | 269/93 X |
| 2,203,162 | 6/1940 | Lee . | |
| 3,425,681 | 2/1969 | Wing . | |
| 3,441,264 | 4/1969 | De Gaston . | |

FOREIGN PATENT DOCUMENTS

| | | | |
|---|---|---|---|
| 1920407 | 11/1970 | Fed. Rep. of Germany . | |
| 464523 | 1/1914 | France | 269/91 |
| 1334524 | 7/1963 | France | 269/93 |

*Primary Examiner*—Robert C. Watson

*Attorney, Agent, or Firm*—Norman S. Blodgett; Gerry A. Blodgett

[57] ABSTRACT

Workpiece clamp for use on the table of a machine tool, provided with an inverted T-shaped slot, the clamp consisting of a main body which overlies the table and is telescopingly mounted for vertical sliding motion on a base slidable in the T-shaped slot. The main body and the base are each provided with a horizontal extension. The horizontal extensions are vertically aligned for clamping a workpiece between the horizontal extension of the main body and the table. Apparatus are provided for locking the main body on the base in a plurality of relative vertical positions.

4 Claims, 8 Drawing Figures

WORKPIECE CLAMP

BACKGROUND OF THE INVENTION

In the machining of workpieces, it is necessary to fasten the workpiece securely to the table of the machine tool. The invention is specifically directed to a clamp for a machine tool table provided with an inverted T-shaped slot opening onto the upper surface of a work table. In the past, various types of clamps have been used with this type of machine tool table. The prior art clamps have usually consisted of a bolt whose head is T-shaped and which is slidable in a T-shaped slot in the machine tool table. The bolt extends upwardly from the table, passes through a clamping element, and a large nut is threadingly mounted on its upper end. The clamping element includes an elongated portion which extends horizontally from the bolt and rests on the upper portion of the workpiece. The bottom of the workpiece rests directly on the upper surface of the work table. The workpiece is clamped tightly in place by rotating the nut at the top of the bolt. The thread provides all the vertical support for the clamp and the clamping axis is spaced from the bolt axis, thereby producing a moment arm acting to distort the bolt and creates a considerable amount of compressive force on the limited number of threads which are engaged by the nut in a particular clamping position. These and other difficulties experienced with the prior art clamps have been obviated in a novel manner by the present invention.

It is, therefore, an outstanding object of the invention to provide a workpiece clamp comprising two telescoping pieces, one of which provides all of the vertical support for the clamp.

Another object of the present invention is the provision of a workpiece clamp design which is strong, durable, and not affected by the various forces involved in clamping a workpiece.

A further object of the instant invention is the provision of a workpiece clamp which is adjustable for clamping a wide size range of workpieces.

It is another object of the instant invention to provide a workpiece clamp in which the main body is provided with two clamping elements which are selectively utilized to clamp workpieces within different size ranges.

A still further object of the invention is the provision of a workpiece clamp comprising two telescoping elements, including means for adjustably locking one element in a wide range of vertical positions relative to the other element and wherein the clamping element is adjustably mounted with respect to one of the portions.

It is a further object of the invention to provide a workpiece clamp which is simple in construction, easy and inexpensive to manufacture, and is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the invention consists of a workpiece clamp for use in holding a workpiece on the upper surface of a table of a machine tool which has an inverted T-shaped slot opening on the table surface. The clamp has a main body adapted to overlie the upper surface of the table and includes an upper horizontal extension which functions as the clamping element and a base adapted to slide in the slot, having a bottom horizontal extension which is vertically aligned with the horizontal extension of the main body and an elongated vertical extension mounted for vertical sliding movement with respect to the main body. A bolt extends freely through a vertical aperture in the main body and is threaded into a vertical threaded bore in the vertical extension of the base portion for adjustably locking the main body relative to the base to enable the clamping portion of the main body to occupy a wide range of vertical clamping positions.

More specifically, the main body is provided with an elongated vertically extending cavity open at the bottom for receiving the vertical extension of the base in sliding fit and, wherein the cavity and vertical extension are both cylindrical. A further specific feature of the invention is to provide the main body with an outer threaded cylindrical surface and to provide a nut integrally formed with the clamping element and threadingly mounted on the outer threaded surface of the body. A further feature of the invention is to provide a main body with two horizontally-extending clamping portions located at different vertical levels offset by 180° from the vertical axis of the main body and wherein means are provided for changing the clamping position of the main body with respect to the base for selectively positioning either of the horizontally-extending clamping portions and the clamping position with respect to the base portion.

BRIEF DESCRIPTION OF THE DRAWINGS

The character of the invention, however, may be best understood by reference to one of its structural forms, as illustrated by the accompanying drawings in which.

DESCRIPTION OF THE PREFERRED EMBODIMENT

Figure 4:
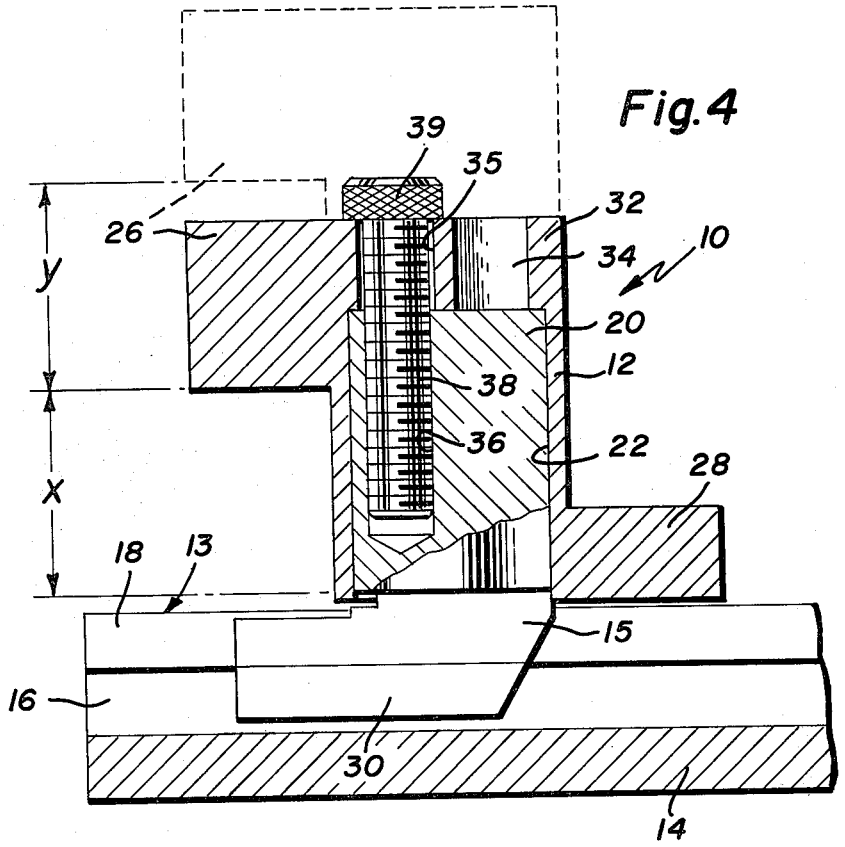
FIG. 4 is a vertical sectional view of the clamp taken on the line IV—IV of FIG. 2 and showing the clamp in a first position.
Figure 5:
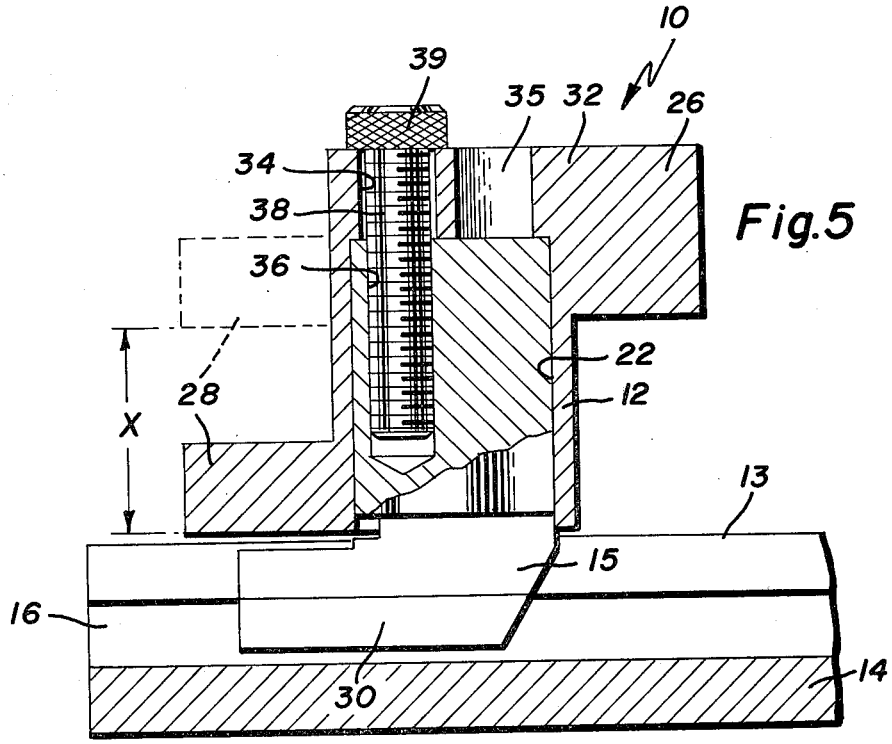
FIG. 5 is a view similar to FIG. 4 showing the clamp in a second position.

Referring to FIGS. 1–5, the preferred clamping embodiment is generally indicated by the reference numeral 10. It consists of a main body 12 adapted to overlie the upper surface 13 of a machine table 14 and of a base 15 of inverted T-shaped cross-section adapted to slide in the inverted T-shaped cross-sectional groove 16 which opens onto the upper surface 13 of the table, the opening being indicated by the reference numeral 18. Base portion 15 has an integrally formed vertically-extending cylindrical portion 20 which extends into a cylindrical elongated cavity 22 in the main body 12, cavity 22 being provided with a lower opening 24 for reception of the vertically-extending portion 20. Main body 12 is provided with a pair of integrally formed upper and lower horizontal extensions 26 and 28, respectively, located 180° apart. Horizontal extensions 26 and 28 each function as the upper clamping element for engaging the top of a workpeice W shown in dot and dash lines. The bottom of the workpiece rests on the surface 13 of the work table above a bottom horizontal extension 30 of the base portion. The main body has a top portion 32, provided with vertical apertures 34 and 35 which are selectively aligned with a vertical bore 36 in vertical extension 20. FIG. 14 shows the clamp in a first position in which aperture 35 is aligned with bore 36 and FIG. 5 shows the clamp in a second position in which aperture 34 is aligned with bore 36. In the first position of the clamp, extension 26 is vertically aligned with extension 30 of the base. In the second position of the clamp, extension 28 is vertically aligned with extension 30 of the base. A bolt 38 extends freely through aperture 34 or 35 and is threaded into bore 36. Bolt 38 has a head 39 which has a greater diameter than apertures 34 and 35, so that by turning bolt 38, the vertical position of the main body 12 may be adjusted with respect to the base 15.

Figure 1:
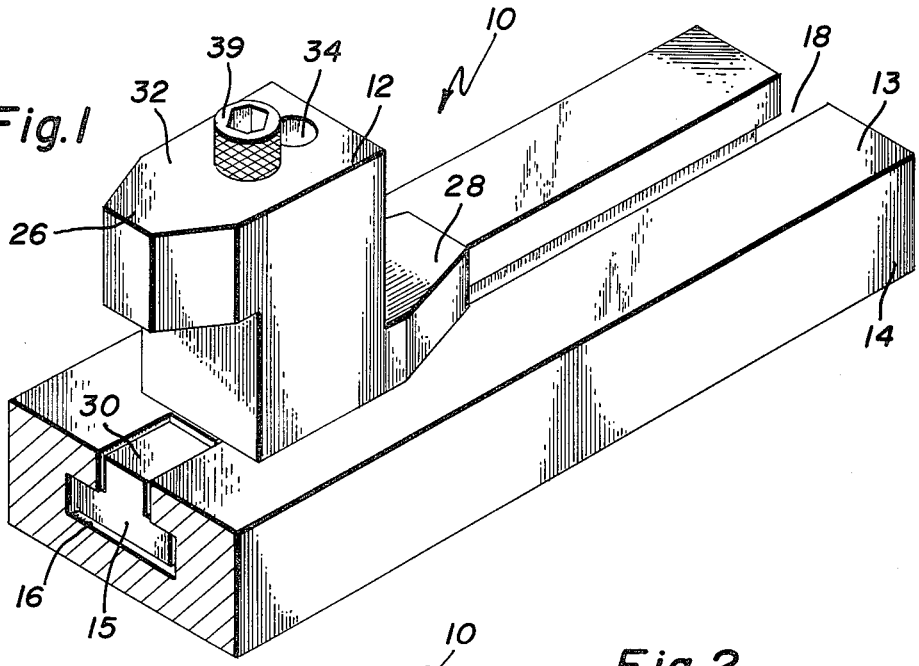
FIG. 1 is a perspective view of the preferred form of the workpiece clamp embodying the principles of the present invention.
Figure 2:
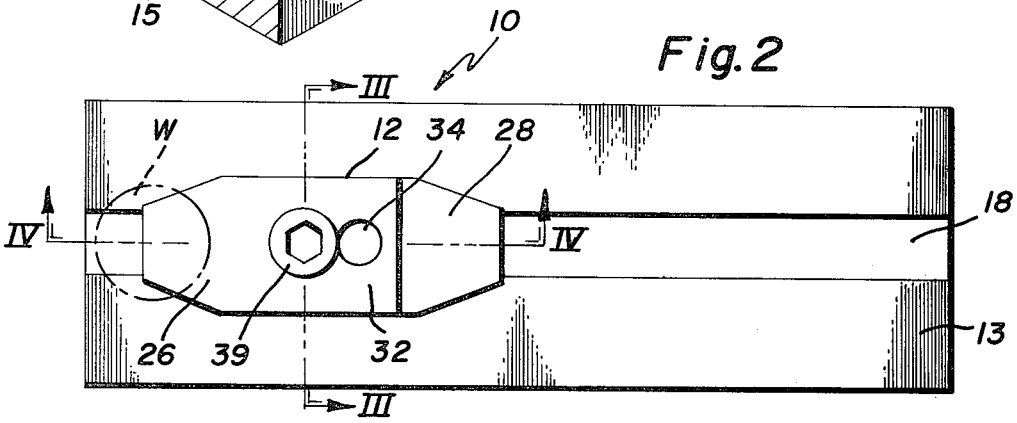
FIG. 2 is a plan view of the clamp shown in FIG. 1.
Figure 3:
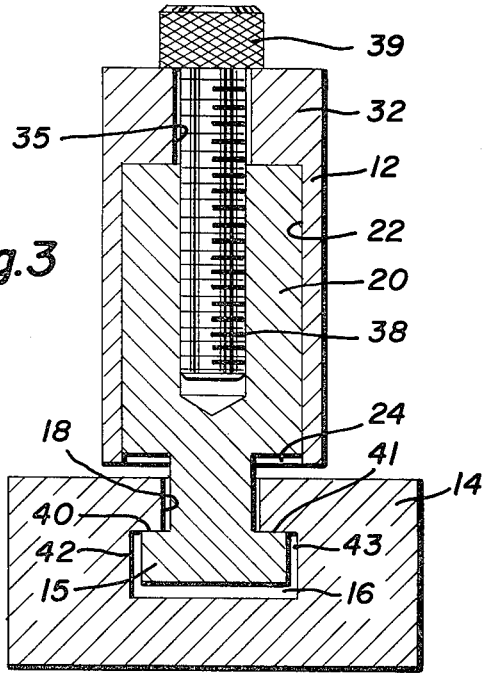
FIG. 3 is a vertical sectional view of the clamp taken on the line III—III of FIG. 2.

The operation and the advantages of the preferred embodiment will now be readily understood in view of the above description. The workpiece W to be clamped is positioned on surface 13 of the work table, in dot and dash lines as shown in FIG. 1 and one of the horizontal extensions 26 and 28 is positioned on the top surface of the workpiece. Once the horizontal extension 28 is positioned above the workpiece, the actual clamping of the workpiece is accomplished by tightening bolt 38. As the bolt 38 is rotated, the base 15 is drawn upwardly until the top surface 40 and 41 of the T-shaped base 15 contacts the downwardly-directed surfaces 42 and 43, respectively, of the T-shaped slot 16. As shown in the drawings, the slot 16 is provided with considerably clearance to enable the T-shaped base portions to slide freely within the slot in spite of grit or chips which always accumulated in the slot as a result of machining operations. For clamping workpieces of particularly small size, the body portion 12 is positioned with respect to the base portion 15 in the second position shown in FIG. 5 so that the extension 28 is aligned with the extension 30 of the base for clamping workpieces within the size range X. By backing off bolt 38, extension 28 can be vertically adjusted from a lower position indicated in full lines to an upper position indicated in dotted lines. For clamping workpieces having a vertical dimension greater than the top of the X range, the bolt 38 is removed from the clamp. The body portion 12 is rotated 180° with respect to the base 15, from the position shown in FIG. 5 to the position shown in FIG. 4. The bolt 38 is then inserted through aperture 35 and rethreaded into the bore 36. In this position, as shown in FIG. 4, the upper horizontal extension 26 is aligned with the bottom horizontal extension 30. With the clamp 10 in the operating mode shown in FIG. 4, it is effective to clamp workpieces having a vertical dimension in the Y range. The Y range extends upwardly from the upper limit of the X range. Clamp 10 of the preferred embodiment is very sturdy, easy to operate, and is very versatile.

FIRST MODIFICATION

Figure 6:
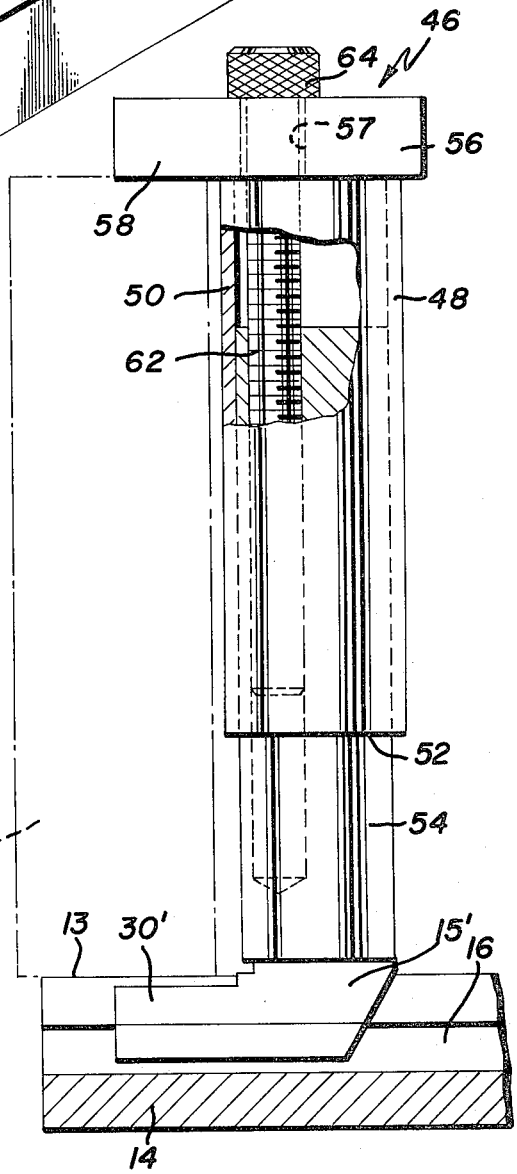
FIG. 6 is a side elevational view of a first modification with portions in section.

Referring to FIG. 6, there is shown a first modification of the invention, generally indicated by the reference numeral 46. The first modification comprises a cylindrical main body 48 provided with a vertically-extending cylindrical cavity 50 which has a lower opening 52. An inverted T-shaped base portion 15' is provided with a bottom horizontal extension 35 identical to extension 30 of the preferred embodiment for slidably engaging the inverted T-shaped slot of the table 13. Base 15' has a vertical extension 54 which extends upwardly through opening 52 in a sliding telescoping fit within the cavity 50 of the main body. The main body 48 has a top portion 56 provided with a vertical aperture 57 and a horizontal extension 58. Vertical extension 54 is provided with a vertical bore 60 which is vertically aligned with the aperture 57 when the body 48 is positioned on the base, so that the horizontal extension 58 is vertically aligned with the bottom horizontal extension 30'. Aperture 57 is large enough so that a bolt 62 extends freely through the aperture and is threadedly engaged in vertical bore 60. Bolt 62 has a head 64 which is larger than the aperture 57, so that turning of bolt 64 will cause the body 48 to slide vertically on the vertical extension 54 to any desired position for clamping a workpiece. Clamping of the workpiece is similar to that of the preferred embodiment, except that all of the adjustment in height of the horizontal extension 58 with respect to the top surface of the table, is accomplished through the turning of the bolt 62. After the horizontal extension 58 is positioned at the top surface of the workpiece, the clamp is tightened by turning bolt 62 in the same manner as in the preferred embodiment.

SECOND MODIFICATION

Figure 7:
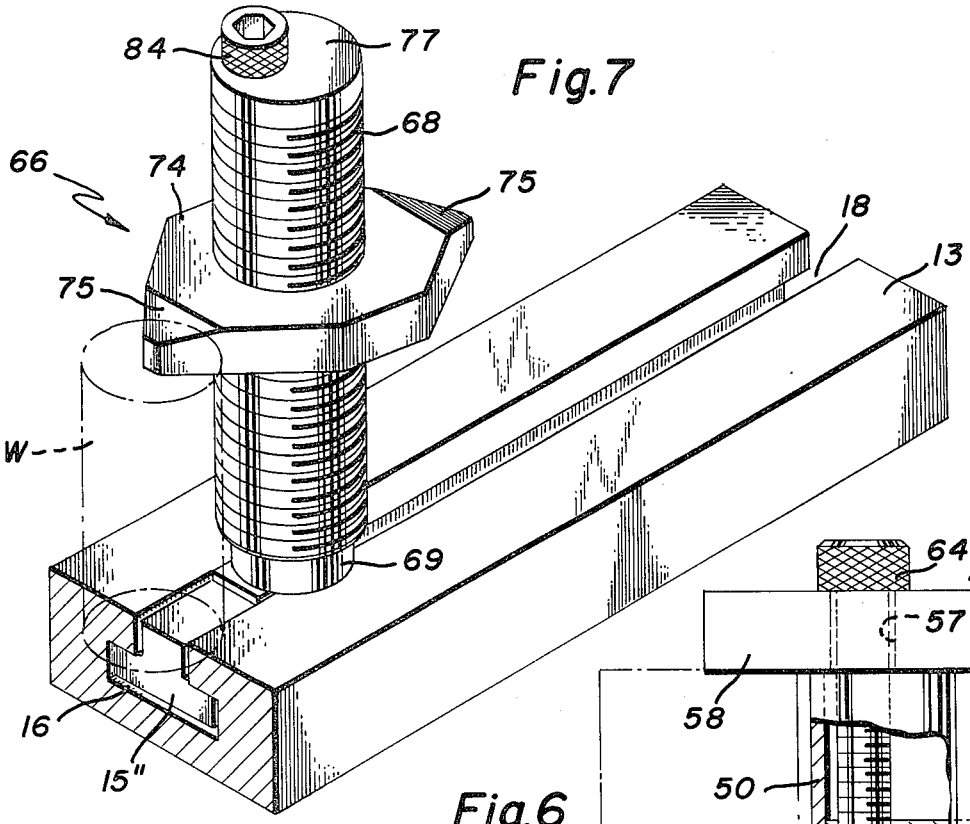
FIG. 7 is a perspective view of a second modification.
Figure 8:
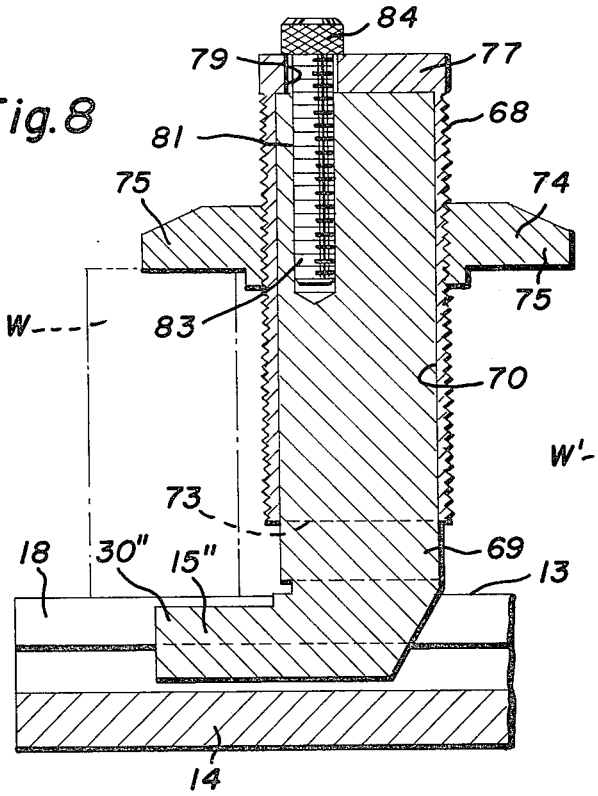
FIG. 8 is a vertical sectional view of the second modification.

Referring to FIGS. 7 and 8, there is shown a second modification generally indicated by the reference numeral 66. It consists of a cylindrical main body portion 68 and a T-shaped base portion 15''. Base portion 15'' has an integrally formed vertically-extending cylindrical portion 69 which extends into a cylindrical elongated cavity 70 in the main body 68, cavity 70 being provided with a lower opening 73 for reception of the vertically-extending portion 69. The outer surface of the main body 68 is provided with threads for receiving a nut 74 provided with a pair of integrally formed upper horizontal extensions 75 located 180° apart. Each of the horizontal extensions 75 functions as the upper clamping element for engaging the top of a workpiece W shown in dot and dash lines. The bottom of the workpiece rests on the surface 13 of the work table above a bottom horizontal extension 30'' of the base portion. The main body has a top portion 77, provided with a vertical aperture 79 which is aligned with a vertical threaded bore 81 in vertical extension 69. A bolt 83 extends freely through aperture 34 and is threaded into bore 81. Bolt 83 has a head 84 which is larger than aperture 79, so that by turning bolt 83, the vertical position of the main body 68 may be adjusted with respect to the base 15''.

The operation and the advantages of the second modification will now be readily understood in view of the above description. The workpiece W to be clamped is positioned on surface 13 of the work table, as shown in FIGS. 7 and 8 and one of the upper horizontal extensions 75 is positioned on the top surface of the workpiece either by rotating the nut 74 on the main body 68, or by turning the bolt 83, thereby allowing the main body 68 to be moved vertically relative to the vertical-extension 69 of the base portion 15''. The use of the combination of an adjusting nut and adjusting bolt provides a greater clamping range than the use of either alone. However, once the horizontal extension 75 is positioned above the workpiece, the actual clamping of the workpiece is accomplished by tightening bolt 83. As the bolt 83 is rotated, the base 15" is drawn upwardly as in the preferred embodiment. The vertical extension 69 provides a rugged vertical supporting structure for the clamp and the combination of a threaded nut 74 together with the adjustable feature of the main body 68 on the vertical extension provide clamping versatility. This enables the clamp to be quickly and easily positioned relative to the workpiece, and provides a clamp which is easily and reliably tightened to securely hold the workpiece in machining positions.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Workpiece clamp for holding a workpiece of a machine having an inverted T-shaped slot opening onto the upper surface of a table comprising:

(a) a main body adapted to overlie the upper surface of the table, said main body having a top portion with a vertical aperture, and an upper horizontal extension, (b) a base of T-shaped cross-section adapted to slide in said slot, said base having a bottom horizontal extension of the said main body, and an elongated vertical extension with an upper threaded bore beneath said top portion, said base being mounted for vertical sliding movement with respect to the main body, said main body having an elongated vertically-extending cavity below said top portion and open at the bottom for receiving said vertical extension in a sliding fit, and (c) a bolt extending freely through said aperture and threaded into the upper threaded bore, said bolt comprising a head, the horizontal dimension of which is greater than that of said aperture, whereby the distance between the upper and bottom horizontal extensions is adjustable, the main body being provided with a lower horizontal extension located 180° from the upper horizontal extension, the main body being slidably mounted on the vertical extension of the base in two relative positions, including a major position wherein the bottom horizontal extension is aligned with the upper horizontal extension and a minor position wherein the bottom horizontal extension is aligned with the lower horizontal extension, said top portion being provided with a second vertical aperture which is vertically aligned with the upper threaded bore when the main body is in said major position.

2. Workpiece clamp as set forth in claim 1, wherein the vertical extension and the cavity are cylindrical.

3. Workpiece clamp as set forth in claim 1, wherein said cavity and said vertical extension are both cylindrical.

4. Workpiece clamp as set forth in claim 3, wherein a substantial portion of the main body is cylindrical, the central axis of which is vertical.

* * * * *